United States Patent [19]

Potter

[11] 4,300,422

[45] Nov. 17, 1981

[54] APPARATUS FOR CUTTING FILAMENTARY MATERIAL

[75] Inventor: Jerry F. Potter, Seaford, Del.

[73] Assignee: E. I. Du Pont de Nemours and Company, Wilmington, Del.

[21] Appl. No.: 153,213

[22] Filed: May 27, 1980

[51] Int. Cl.[3] ..... D01G 1/04

[52] U.S. Cl. ..... 83/99; 83/165; 83/166; 83/346; 83/913

[58] Field of Search ..... 83/98, 99, 100, 346, 83/347, 913, 165, 166

[56] References Cited

U.S. PATENT DOCUMENTS

| | | | |
|---|---|---|---|
| 3,011,257 | 12/1961 | Bamberger | 30/128 |
| 3,485,120 | 12/1969 | Keith | 83/37 |
| 3,733,945 | 5/1973 | Cook | 83/913 X |
| 3,777,610 | 12/1973 | Spaller, Jr. | 83/913 X |
| 3,942,401 | 3/1976 | Roncato | 83/98 X |
| 3,945,280 | 3/1976 | Roncato | 83/98 X |
| 3,985,053 | 10/1976 | Kayser et al. | 83/100 |
| 4,083,276 | 4/1978 | Hutzezon | 83/913 X |
| 4,120,222 | 10/1978 | Potter | 83/99 |

*Primary Examiner*—James M. Meister

[57] ABSTRACT

A modification to a reel type staple cutter that includes a compartmentalized assembly located below the cutter reel, each compartment forms an isolated cutting zone which reduces the opportunity for falling tufts of cut staple to mix and intermingle to form clumps which are difficult to open. The curved top plate of each compartment provides a downward force vector which assists gravitational forces and injected air to overcome centrifugal and adhesive forces tending to prevent staple from falling. Plates and baffles attached to a stationary shell located beneath the cutter reel split the cut fibers into discrete tufts despite the cohesive nature of the product and promote flow down and from each compartment.

5 Claims, 6 Drawing Figures

APPARATUS FOR CUTTING FILAMENTARY MATERIAL

BACKGROUND OF THE INVENTION

The invention relates to apparatus for cutting elongated material into shorter lengths and the means for uniformly removing the cut material. More particularly, the invention provides a means for overcoming centrifugal and adhesive forces that tend to prevent the staple from freely falling from the cutter reel.

Cutters as described by Keith in U.S. Pat. No. 3,485,120 are broadly used for cutting tow into staple length fibers. These cutters include a rotatable reel having outwardly facing cutter blades against which the tow is wound and a fixed pressure roller pressing upon the tow wound around the reel resulting in cutting of the innermost layers of tow by the cutter blades. As cutting progresses a wad of cut staple fibers is forced inwardly between adjacent pairs of blades. Unfortunately, centrifugal forces and interfiber adhesion resist removal of wads of cut fibers by gravitational forces. Thus the wads of cut fibers continue to rotate with the reel and continue to increase in size until either the cutter jams or until chips of cohered staple break off from the wads and fall into the collection hopper. These chips are heavily entangled, difficult to open, and cause subsequent difficulties in mill processing.

Cook in U.S. Pat. No. 3,733,945 recognizes the problems of jamming the cutter and lack of staple openness using cutters described by Keith and as a solution to these problems Cook discloses mounting at least one fixed jet so that it jets air downwardly upon the proximity of the doffing point of the cut fiber through aligned apertures in the cutting reel which rotate past the jet. This assists the gravitational forces in overcoming the effect of centrifugal and fiber-to-fiber forces allowing the cut fiber to fall freely downward. However, Cook's arrangement has disadvantages associated with discontinuous passage of air from the fixed jet through apertures in the reel crossing through the air jet stream. Cook's arrangement is essentially that of a siren and as a consequence produces very high noise levels.

Potter U.S. Pat. No. 4,120,222 is a modification of the known reel type cutter wherein the jet-producing orifices rotate with the reel and by not interrupting jet-air flow, as with Cook, a negligible increase in noise level results, regardless of orifice size or operating speed of the reel.

While the reel-type cutters of the prior art provide a staple exhibiting fairly uniform openness with substantially no fiber chips, a further means has been discovered to assist gravitational forces and injected air to overcome the centrifugal and adhesive forces permitting the cut staple product to fall more freely in smaller tufts.

SUMMARY OF THE INVENTION

In an apparatus for cutting filamentary material into predetermined lengths comprising a cutting assembly including a plurality of knife edges secured to a reel having an upper and a lower mounting member and having means adapted to receive successive wrappings of filamentary material to be cut in contact with said plurality of knife edges and means for forcing said material between adjacent knife edges to a doffing point thereby severing said filamentary material into lengths of controlled dimensions, the improvement comprising:

a cone attached at its base to said upper mounting member; a plurality of outwardly directed vanes attached to said cone, each pair of said vanes spanning a doffing point; a plate spanning each pair of vanes, said plate extending in an inwardly curved direction from said upper mounting member near said blades to said cone; and an orifice supplied with pressurized fluid in said plate directed toward the proximity of the doffing point of the severed material.

The entire assembly—cone, vanes and curved plate—is coated with a nonstick, low friction material, e.g., matte chrome plate, "Teflon"-S nonstick finish (Du Pont's registered trademark for its nonstick finishes), and the like.

The apparatus includes a shell positioned below the reel which contains spaced plates and baffles fixed at different levels around the inner periphery of the shell. In a preferred embodiment the cone and the vanes extend downwardly into the shell within the plates and baffles. In another preferred embodiment the shell containing the plates and baffles is used in conjunction with the cutter reel without the cone and the vanes.

DETAILED DESCRIPTION OF THE PREFERRED EMBODIMENTS

Figure 4:
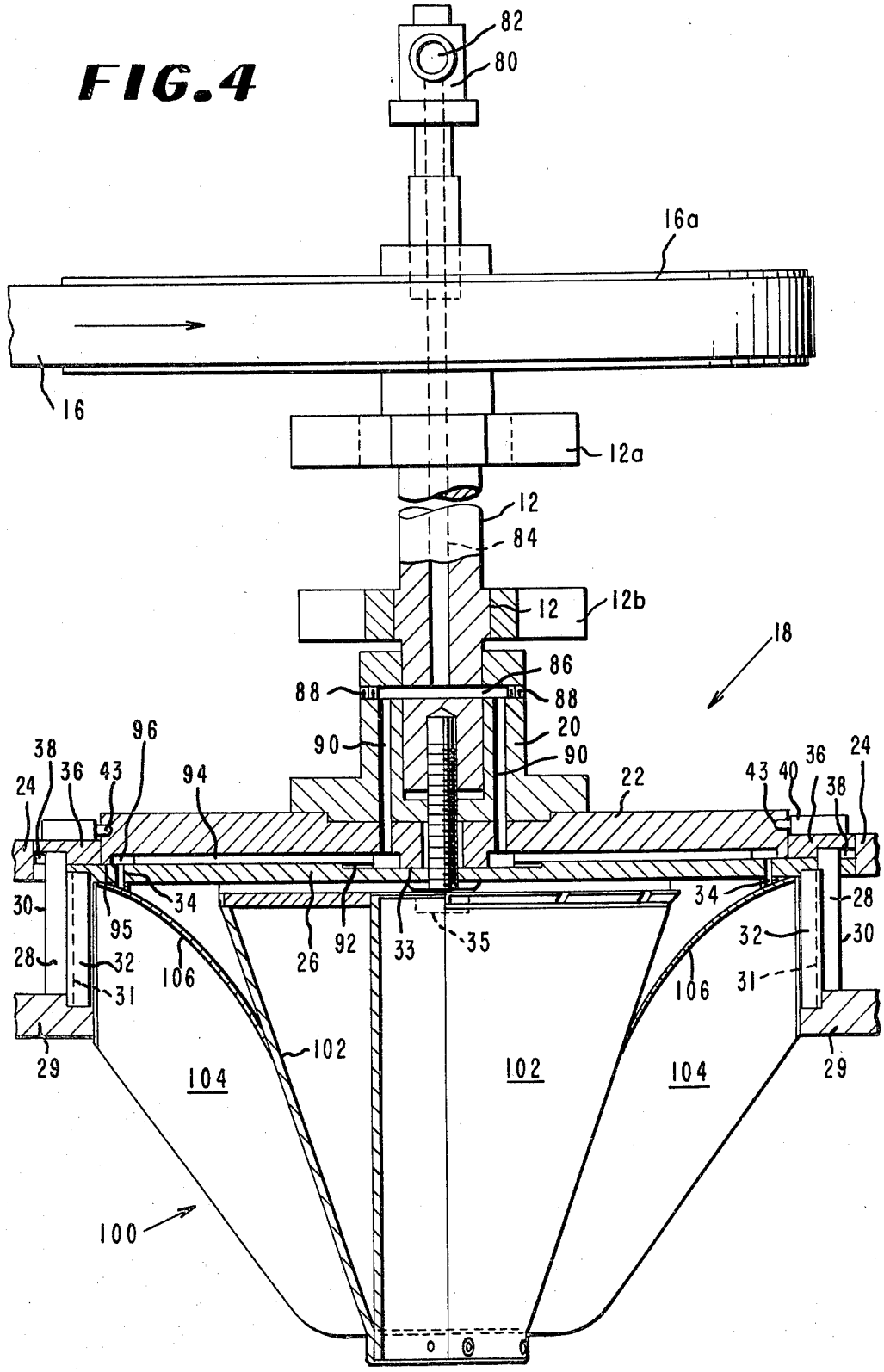
FIG. 4 is an enlarged detailed partially sectioned elevation view of the reel and drive shown in FIG. 1.

Referring to the drawings, the embodiment chosen for purposes of illustration is a cutting apparatus 10 that includes as its major components a drive shaft 12 mounted on a base 14 by means of bearings **12*a* and 12*b* and connected to a cutting reel designated generally 18. The shaft 12 is driven by a motor (not shown) via belt 16 engaging pulley 16*a* attached to shaft 12. Referring to FIG. 4, the cutting reel 18 is seen to comprise a bottom ring 29 attached to and spaced from a top plate 26 by spaced connector posts 32 which are secured in position by any of a number of well known expedients as, for example, brazing. A guiding ring 24 for the material being cut extends circumferentially around top plate 26 and is attached to the peripheral edge of plate 26. As an alternative the ring 24 could be made integral with plate 26. Rectangular cutter blades 28 are inserted through slots in top plate 26 down into grooves in the top of ring 29. When in place, each cutter blade 28 has its cutting edge 30 facing radially outwardly, and its back edge supported in U-groove 31 of a connector post 32 and its top end extending into annular space 38 above plate 26. A cover plate 22 is bolted to top plate 26 (bolts not shown). Fitted between cover plate 22 and tow guiding ring 24 is retaining ring 36 which has a stepped lower surface to provide space 38 into which the top of cutter blade 28 extends. Spaced fasteners 40 are attached to the upper surface of retaining ring 36 and have slide bolts 43 which extend into corresponding holes in the edge of cover plate 22 holding the retaining ring 36 securely in position. Thus, the combination of the cover plate 22, top plate 26, guiding ring 24 and retaining ring 36 form what may be generally referred to as the upper mounting member of the cutting reel 18 while ring 29 will be considered the lower mounting member of the reel. An intermediate hub 20 is used between the reel and drive shaft 12 and these portions are fastened to the upper mounting member by a bolt 35 threaded into the bottom of shaft 12**.

Passageways are formed so as to continuously communicate from the top of shaft 12 to orifices 34 formed through top plate 26 near its outer extremities. A rotary union 80 is attached to the top of shaft 12. Fixed piping (not shown) leads high pressure air to rotary union 80 through inlet opening 82 in the rotary union whereby compressed air may be fed to the passageways during rotary operation of the cutter. It is feasible to provide a rotary union around a shaft directly driven by a motor at its end, but the installation is much simpler when the motor is off-set and the rotary union is mounted on the end of the shaft. An axial passageway 84 is provided through most of shaft 12 leading from the inlet 82 and stopping short of the hole receiving bolt 35. At least one transverse passageway 86 is formed through hub 20 and shaft 12 intersecting with the end of passageway 84. The ends of passageway 86 are closed by plugs 88. Next, a pair of passageways 90 is formed vertically through cover plate 22 and hub 20 intersecting at the upper end with passageway 86 and at the lower end with annular chamber 92 formed between cover plate 22 and top plate 26. Channels 94 are machined into the bottom of cover plate 22 and extend from chamber 92 to annular distribution ring 96 also formed in the bottom of cover plate 22 in an area over orifices 34 to form a manifold in communication with each orifice 34, the manifold being in communication with high pressure air through hollow shaft 12. Sealing lip 95, preferably fitted with a gasket, is left around the outside edge to prevent air leakage. Hole 33 provides ready passage of bolt 35. The number of channels 94 is not critical, but a preferred embodiment has three with a total cross-sectional flow-area equal to or greater than that of passage 84.

Figure 1:
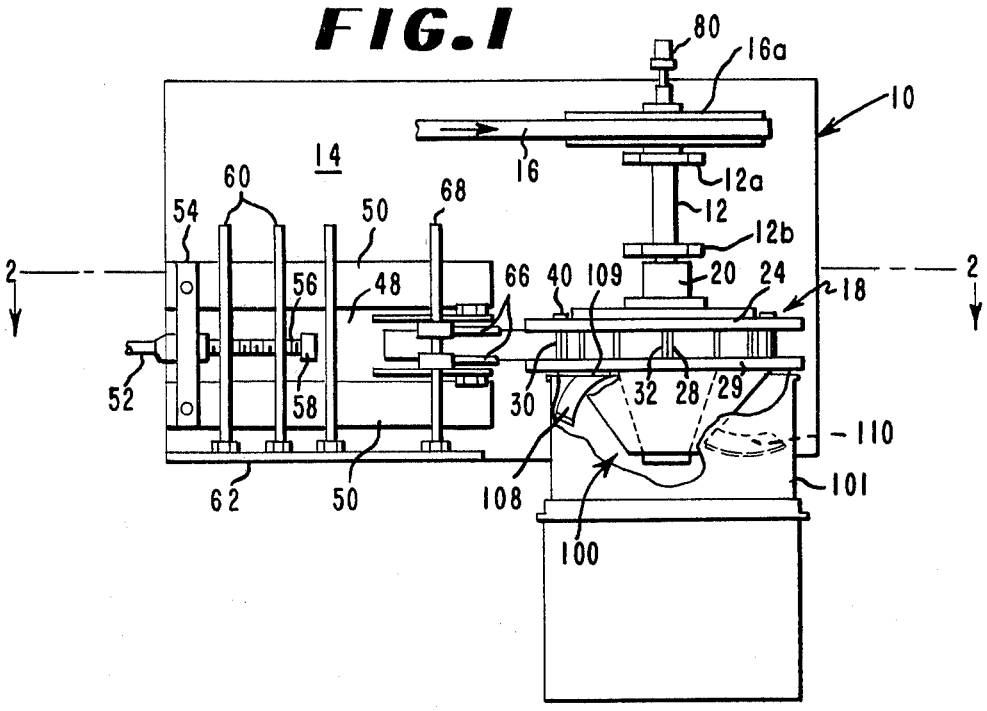
FIG. 1 is a side elevation view of the cutting apparatus similar to the Keith apparatus illustrating the relationship between the various elements thereof and showing a preferred cutting reel configuration.
Figure 2:
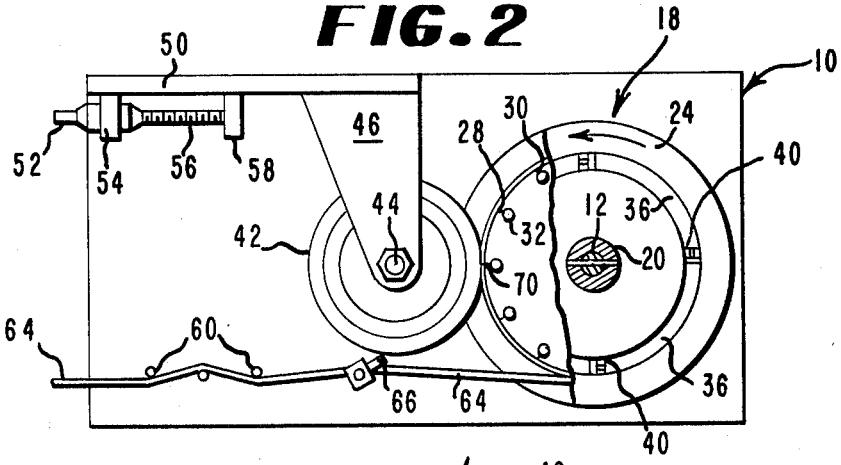
FIG. 2 is a view taken along 2—2 of FIG. 1 showing the relationship between the cutting reel, the pressure applicator and the material being severed.

As best shown in FIGS. 1 and 2, a pressure applicator 42 of the rotatable type such as a wheel or roller is mounted on a shaft 44 secured to a bifurcated bracket 46 which in turn is supported on a movable slide 48 fitted into machined ways 50 secured to the base 14. Regulated movement of the slide 48 is accomplished by a lead screw 52 rotatably secured in a pillow block 54 fixed in position relative to machined ways 50 and thus to the base 14. One end 56 of lead screw 52 is threaded into an appendage 58 integral with or otherwise fixed on the surface of the movable slide 48 so that rotation of screw 52 will cause slide 48 to move relative to machined ways 50 and base 14. This structure, a lead screw actuated slide and ways assembly well known in the art, provides for movement of pressure roll 42 relative to cutting reel 18 and minute adjustment of the space between it and cutting edges 30.

A plurality of finger guides 60 or others well known in the art extend outwardly from a plate 62 secured at right angles to the base 14. For operation at high speeds guides 60 may be rolling guides. The finger guides 60 shape the incoming filamentary tow 64 into a flattened tape or band. From the finger guides 60 the filamentary material or tow passes through rounded edge guides 66 which are pivotally mounted on an elongated rod 68 secured, as are finger guides 60, to plate 62. Guides 66 serve to control the width of the flattened tape band 64 so that it will wind snugly between ring 29 and guiding ring 24 of the cutting reel 18. In addition to flattening the incoming tow 64, the finger guides 60 also serve as a friction brake to place the tow under a controlled amount of tension as it is fed into the cutting reel 18.

Figure 3:
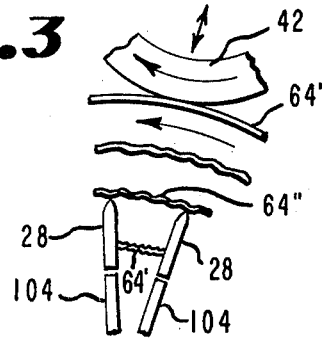
FIG. 3 is an enlarged, fragmentary detail view showing the relationship between the blades, the material being cut, and the pressure applicator at the point of cutting.

The cutter is substantially that disclosed by Cook in U.S. Pat. No. 3,733,945 and by Potter in U.S. Pat. No. 4,120,222, the operation of which is described in detail at column 4, lines 7–47 of the Cook patent. The details of the method of cutting are shown in FIG. 3 wherein a filamentary tow 64' is under maximum tension in the outer wrap and under substantially zero tension at 64''. The problem is that cut fibers 64''' collect in between the knife blades 28 compacting the cut fibers until gravitational forces plus the urging of the air from orifice 34 overcome the combined effect of fiber to fiber adhesive forces and centrifugal force. The point where the combined forces are overcome is called the doffing point.

The improvement of this invention is a modification of the known cutter reels that provides a compartmentalized assembly 100 attached to the upper mounting member of the cutter reel that extends downward into a stationary shell 101 containing opposed baffles 108, 110 and plates 109. The assembly 100 includes a cone 102 attached at its base to top plate 26 and a plurality of outwardly directed vanes 104 attached to the cone. The vanes are angled outward from the cone so that for each pair of vanes their maximum separation occurs near the doff point of the cutter reel, i.e., approximately below orifice 34. The vanes are also tapered inward from the base of the cone toward its apex. A plate 106 spans each pair of vanes 104 and extends in an inwardly curved direction from the upper mounting member 26 near blades 28 to the cone 102. Thus a compartment which is open at the bottom is formed by the combination of cone 102, each pair of vanes 104 and an included top plate 106 which curves inward and downward toward the apex of the cone. The entire spreading cone assembly, i.e., cone 102, vanes 104, and curved plates 106, is coated with "Teflon"-S nonstick finish to provide antifrictional surface characteristics. The curve plate 106 of each compartment is fitted with air orifice 34 by which compressed air may be directed into the compartment to assist in forcing the cut product downward.

This invention retains cut fibers in a highly parallized orientation with minimum fiber-to-fiber entanglement and provides an additional assist to overcoming gravitational and adhesive forces by use of the curved plate 106 which, as the cut product is compressed inward past knives 28 into a compartment, provides a downward force vector that assists gravitational forces and injected air to permit the cut product to fall more freely and in smaller tufts.

Figure 6:
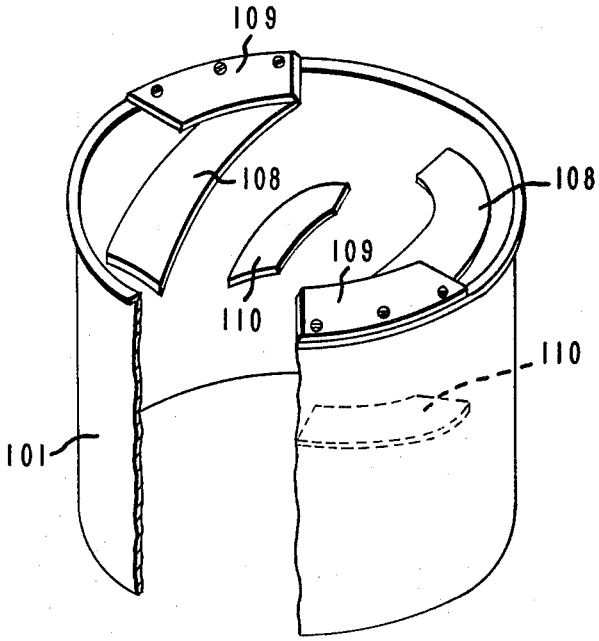
FIG. 6 is a perspective view of the shell partially cut away to show the arrangement of the plates and baffles fixed at different levels around the shell.

As best shown in FIGS. 1 and 6 opposed baffle plates 108, 110 and splitter plates 109 which are affixed at different levels on the stationary shell 101 surrounding the vane assembly 100 provide a further means to more easily open the cut product. Staple tufts exiting a compartment of vane assembly 100 are further opened by the splitter plate 109 which cuts the tuft surface, retaining yarn above the plate while the inclined primary baffle 108, located directly below the splitter plate, forces all product below the splitter plate to flow down the vane. This operation occurs two or more times per revolution of the cutter reel. As product flows downward, the vanes lose their grip on the product because they become shorter as they approach the cone apex. Product blooms out as the vanes become shorter and falls free in small tufts from the vane compartments. Any residual material entangled with product still in the vane compartments is broken loose as centrifugal force throws the tufts outwardly into the secondary angled baffles 110. The splitter plates 109 and baffles 108 are fastened to shell 101 and arranged in groups of three, e.g., one splitter plate 109, one primary baffle 108 and one secondary baffle 110, around the inner surface of the shell (FIG. 6) and act to split, separate, and promote flow down from each cutting compartment.

Figure 5:
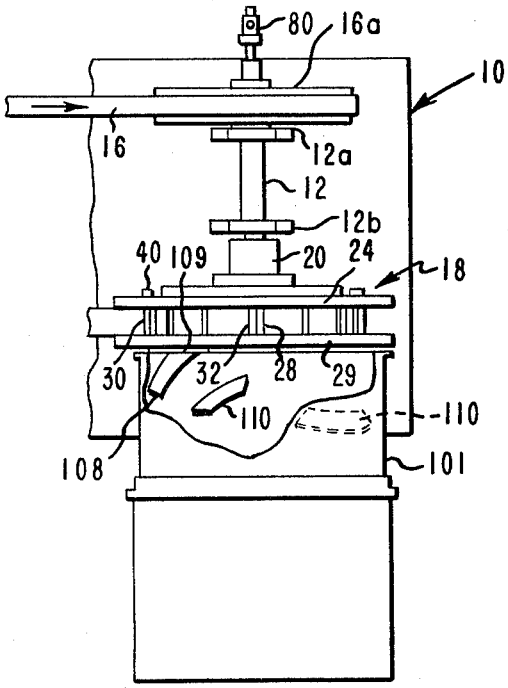
FIG. 5 is a partial side elevation view similar to FIG. 1, without the cone-vane assembly 100.

While the preferred embodiment discloses the cone and vane assembly 100 used in conjunction with the shell 101 containing the baffle plates, satisfactory results can be achieved when the shell 101 containing the plates and baffles is used in comjunction with the cutter reel without the cone and vane assembly 100 as shown in FIG. 5.

I claim:

1. In an apparatus for cutting filamentary material into predetermined lengths comprising a cutting assembly including a plurality of knife edges secured to a reel having an upper and a lower mounting member and having means adapted to receive successive wrappings of filamentary material to be cut in contact with said plurality of knife edges and means for forcing said material between adjacent knife edges to a doffing point thereby severing said material into lengths of controlled dimensions, the improvement comprising: a cone attached at its base to said upper mounting member; a plurality of outwardly directed vanes attached to said cone, each pair of said vanes spanning a doffing point; and a plate spanning each pair of vanes, said plate extending in an inwardly curved direction from said upper mounting member near said blades to said cone.

2. In an apparatus for cutting filamentary material into predetermined lengths comprising a cutting assembly including a plurality of knife edges secured to a reel having an upper and a lower mounting member and having means adapted to receive successive wrappings of filamentary material to be cut in contact with said plurality of knife edges and means for forcing said material between adjacent knife edges to a doffing point thereby severing said filamentary material into lengths of controlled dimensions, the improvement comprising: a cone attached at its base to said upper mounting member; a plurality of outwardly directed vanes attached to said cone, each pair of said vanes spanning a doffing point; a plate spanning each pair of vanes, said plate extending in an inwardly curved direction from said upper mounting member near said blades to said cone; and an orifice supplied with pressurized fluid in said plate directed toward the proximity of the doffing point of the severed material.

3. The apparatus of claim 1 or 2, wherein said cone, said vanes and said plate are coated with a nonstick, low surface friction material.

4. The apparatus as defined in claims 1 or 2 including a shell containing spaced plates and baffles fixed at different levels around the inner periphery of the shell, said cone and said vanes extending downwardly into said shell within said plates and baffles.

5. In an apparatus for cutting filamentary material into predetermined lengths comprising a cutting assembly including a plurality of knife edges secured to a reel having an upper and a lower mounting member and having means adapted to receive successive wrappings of filamentary material to be cut in contact with said plurality of knife edges and means for forcing said material between adjacent knife edges to a doffing point thereby severing said filamentary material into lengths of controlled dimensions, the improvement comprising: a cylindrical shell located below and encompassing the doffing points between adjacent knife edges, said shell containing spaced plates and baffles fixed at different levels to the inner periphery of the shell.

* * * * *